US006129947A

United States Patent [19]

Grissom

[11] Patent Number: 6,129,947

[45] Date of Patent: Oct. 10, 2000

[54] POWDER DUSTER

[76] Inventor: Michael Grissom, 313-M Glen Echo La., Cary, N.C. 27511

[21] Appl. No.: 09/309,533

[22] Filed: May 11, 1999

Related U.S. Application Data

[60] Provisional application No. 60/084,976, May 11, 1998.

[51] Int. Cl.[7] ..... B05D 1/12; B05B 13/06

[52] U.S. Cl. ..... 427/180; 427/181; 427/235; 427/476; 427/478; 427/482; 118/312; 118/319; 118/326; 118/634

[58] Field of Search ..... 427/180, 181, 427/235, 294, 476, 478, 482; 118/317, 326, 312, 634; 239/124

[56] References Cited

U.S. PATENT DOCUMENTS 3,603,287 9/1971 Christy .

3,855,968 12/1974 Saito .

4,334,494 6/1982 Kane .

*Primary Examiner*—Fred J. Parker

*Attorney, Agent, or Firm*—Mills Law Firm PLLC

[57] ABSTRACT

The present invention is a means and method for powder dusting various manufactured products such as extrusions, sheet materials, thin films, and piece parts. The powder dusting system includes a regenerative compressor which propels an air/dust mixture through a control valve body into a cone shaped filter where a majority of the air is filtered out. The remaining concentrated air/dust mixture enters a head component where head jets direct the air/dust mixture to the item that is being coated. The powder duster of the present invention also provides a method of coating manufactured products on both their interior and exterior surfaces.

7 Claims, 4 Drawing Sheets

POWDER DUSTER

RELATED APPLICATION

This application claims the benefit under 35 USC 120 of U.S. Provisional Application No. 60/084,976 filed on May 11, 1998 in the name of Michael Grissom and entitled "Powder Duster".

BACKGROUND OF INVENTION

1. Field of Invention

This invention relates to a method and apparatus for application of powder coatings and, more particularly, the application of powder coatings or dustings to extrusions, sheet materials, thin films, piece parts and various other items without release of the dusting material into the atmosphere.

Manufacturers, such as extruders, use dusting to speed up their manufacturing process. When material exits the extruder, it is hot and tacky. Dusting is used to coat the extruded material so that it can be quickly moved to the next phase of the manufacturing process without having to wait for the material to cool. Examples of this include car moldings, wiper blades, seals and the like. In addition to extruded products, there are many other manufacturing operations that use dusting as part of their manufacturing process. Quite often the powder coating for dusting are talcum or cornstarch and can be used on rubber, silicon, plastic, bread, wire extrusions and the like.

All of the powder coating or dusting systems heretofore used have had difficulty providing uniform coatings and are invariably "dirty", releasing large amounts of dusting particles into the atmosphere which is a direct violation of Environmental Protection Agency regulations. These "dirty" dusting systems waste large amounts of powder and require additional and costly safeguards for employees as well as other plant equipment.

2. Concise Explanation of Prior Art

There is no known prior art that functions in a manner similar to the present invention.

BRIEF DESCRIPTION OF INVENTION

The powder duster of the present invention is designed to put powder coatings, such as talcum or cornstarch on any shape product without releasing dusting particles. The coatings are uniform and the ambient atmosphere complies with the Environmental Protection Agency regulations concerning airborne contaminants.

The above is accomplished through the use of a turbo-static head creating a high velocity vortex from all radial angles insuring optimum coating even on odd shaped products. The head itself has no moving parts and is maintenance free.

As the dusting material moves through the channels in the head, it picks up an electrostatic charge. When the powder material exits the head and creates the vortex, the electrostatic charge in the dusting material causes it to bond to the products being dusted. The filter used on the duster of the present invention is capable of retaining particles down to 0.03 microns, has no moving parts and does not need cleaning or cycling.

When the system of the present invention is an operation, the vortex effect pulls in and filter cleans large amounts of ambient air per minute.

In view of the above, it is an object of the present invention to provide. a system for applying even powder coatings to products while preventing the release of excess powder into the ambient atmosphere.

Another object of the present invention is to provide a system that uses a turbo-static head that creates a high velocity vortex to ensure optimum coating of even odd shaped products.

Another object of the present invention is to provide a system wherein dusting material moves through channels in a head that picks up an electrostatic charge which causes the dusting material to bond to the products being dusted.

Another object of the present invention is to provide a dusting system wherein the dusting head has no moving parts and does not need cleaning or cycling.

Other objects and advantages of the present invention will become apparent and obvious from a study of the following description and the accompanying drawings which are merely illustrative of such invention.

Figure 1:
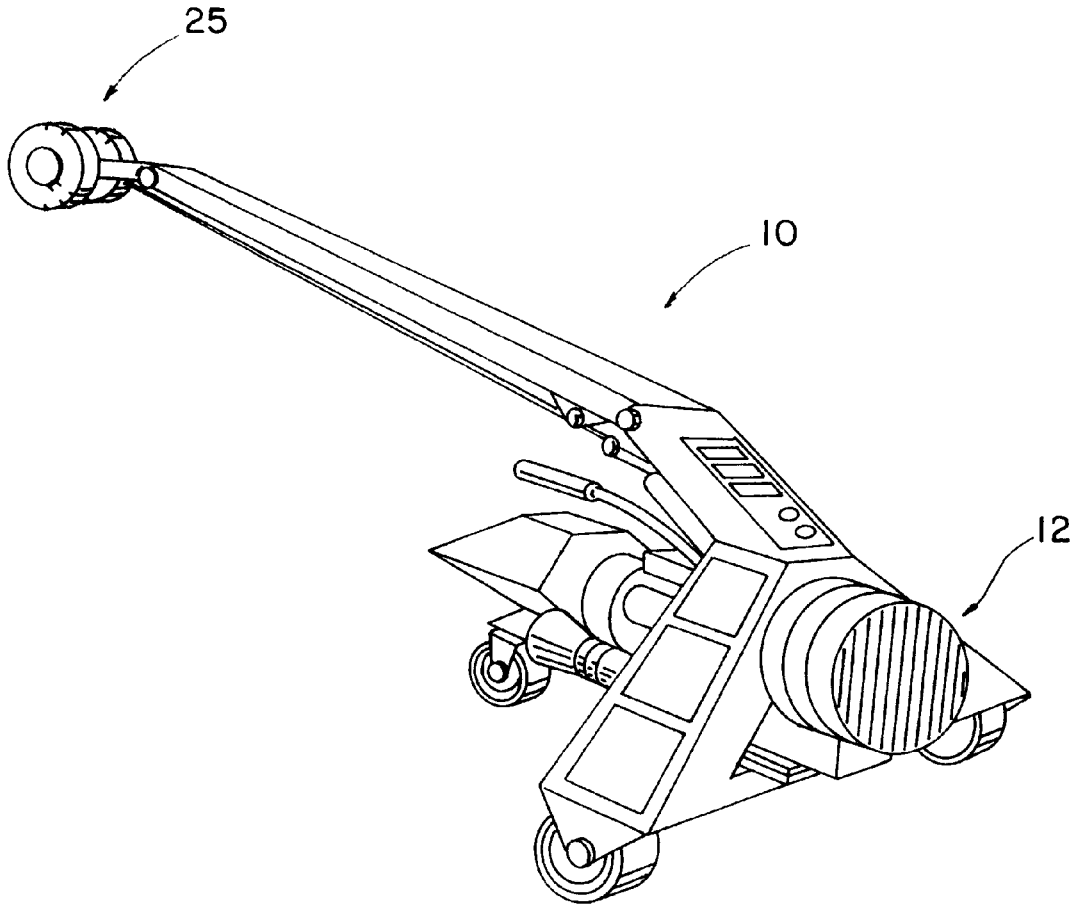
FIG. 1 is a perspective view of the duster system of the present invention.

With further reference to the drawings, the powder duster of the present invention, indicated generally at 10, includes a turbo-static head portion, indicated generally at 25, and a regenerative compressor portion 12, indicated generally at 12.

DETAILED DESCRIPTION OF INVENTION

The regenerative compressor 12 provides propulsion of the air/dust mixture through control valve body 14 to input 16 of the cone filter, indicated generally at 20. Approximately 90% of the air in the mixture will be filtered out before reaching the output 18 of such filter. The remaining concentrated air/dust mixture enters the head 25, wherein it is centrifugally routed to jets 24 that direct the air/dust mixture to the item to be powder coated or dusted, such as the extrusion indicated at 22.

The excess powder that does not adhere to extrusion 22 combines with ambient air from outside the head 25 and is returned to valve body 14 by means of the vacuum created by the regenerative compressor 12 thereby completing the flow cycle.

A secondary function of the valve body 14 makes possible the closed loop application of powder coatings to the inside of an extrusion 22 such as a tube or hose. By tapping the output 27 of the regenerative compressor 12, and routing it to the interior of the extrusion die plate 29, the air/dust mixture is directed through the internal cavity of extrusion 22 to a take-up reel, indicated generally at 36, which is similar to an internally fed garden hose reel. The air/dust mixture is extracted from the center 35 of the reel, where it is routed back to the input of valve body 14 by means of the vacuum created by the regenerative compressor 12 thus completing the flow cycle.

Figure 3:
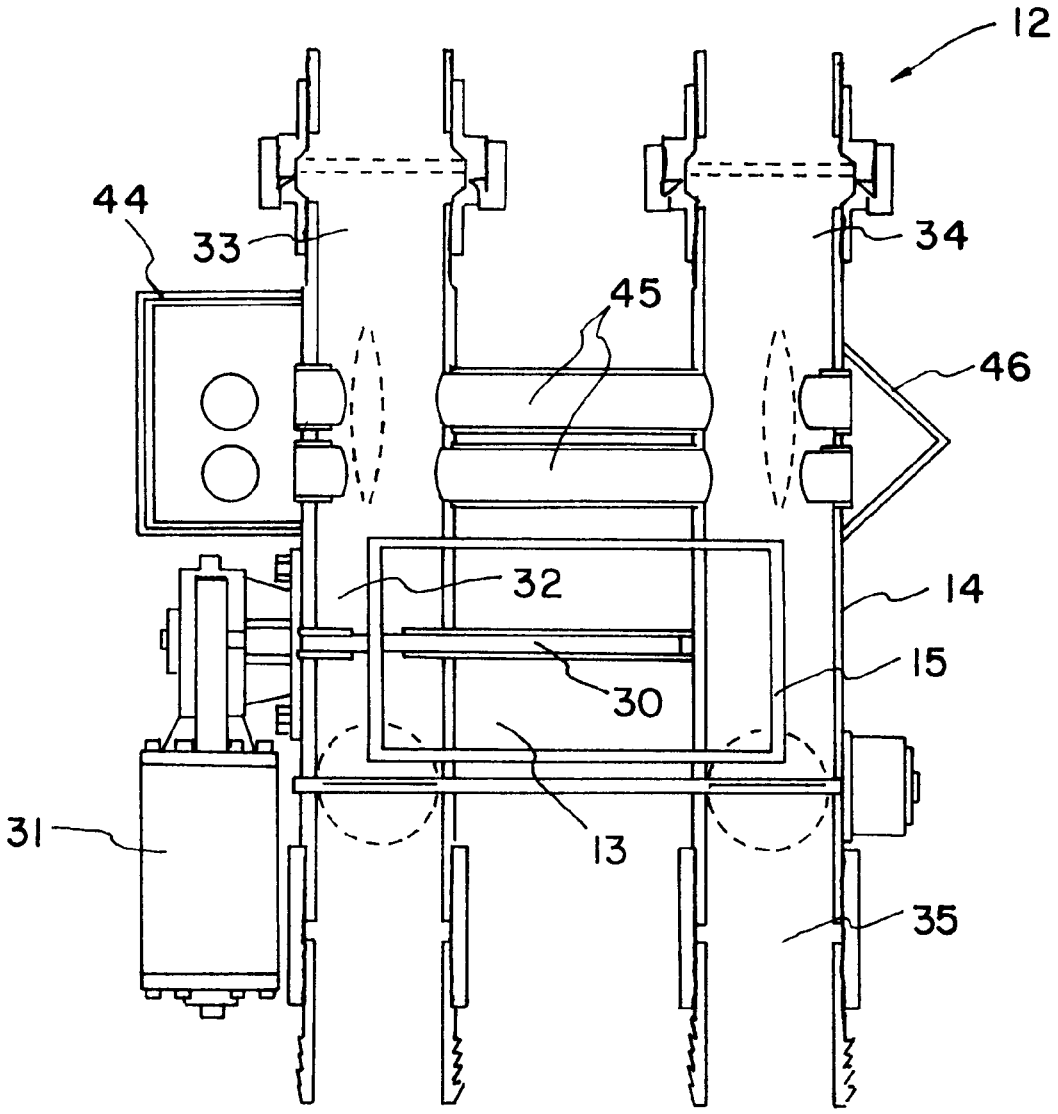
FIG. 3 is a schematic representation of the feed chamber.

The external coating process is initiated by placing bulk powder in hopper 15 located directly above and attached to the gravity fed volumetric feed chamber 13 as shown in FIG. 3.

The bulk powder is dispensed from the chamber 13 by an auger screw 30 driven by gear-motor 31 into the vacuum air stream 32 and into vacuum inlet 33 of compressor 12.

Figure 2:
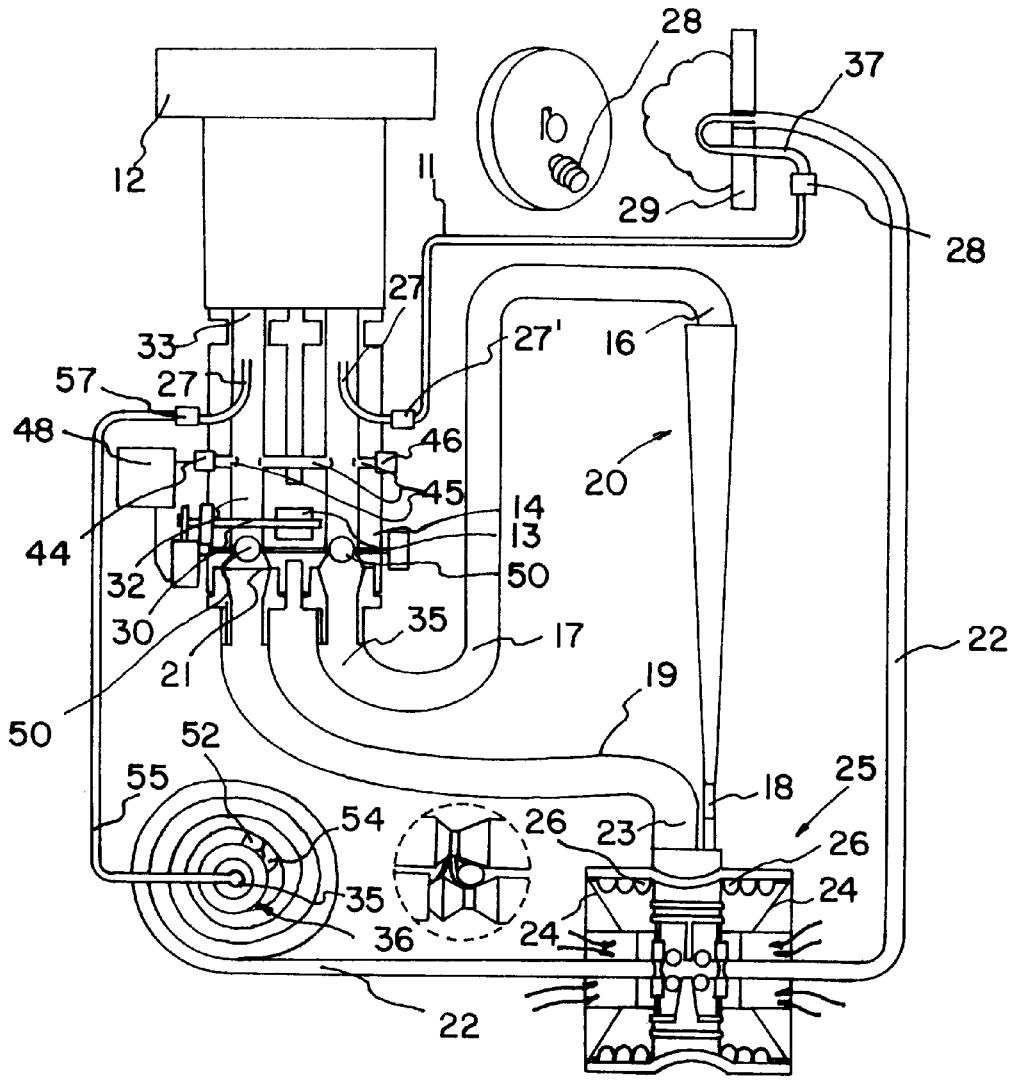
FIG. 2 is a schematic representation of the duster system of the present invention schematically.

The air/dust mixture is pressurized to between 3 to 5 Psi and exits the outlet 34 of compressor 12, passes through the pressure side of the valve body to the outlet 35 thereof where the air/dust mixture is routed via tube 17 to input 16 of cone filter 20 as shown in FIG. 2.

The cone filter 20 is designed to bleed off 90% of the air component through 0.03 micron holes in the filter walls while maintaining 100 fps or greater mixture velocity which is required to prevent clogging of the internal filter walls.

Figure 4:
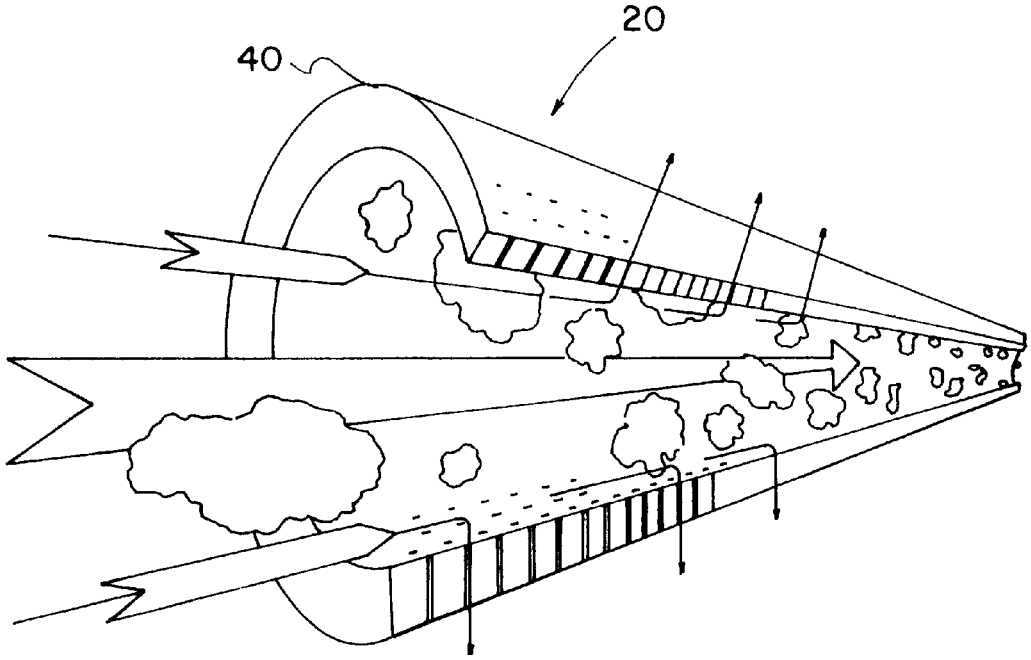
FIG. 4 is a cut-away schematic view of the cone filter of the present invention.
Figure 5:
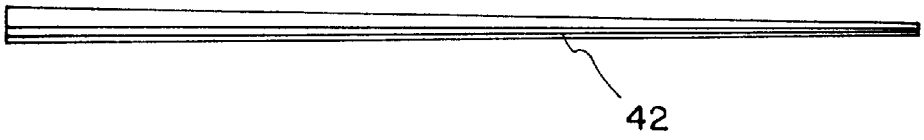
FIG. 5 is a side elevational view of the tapered tube for the cone filter.

As shown in FIG. 4, the internal filter wall 40 is made by constructing the tapered tube 42 shown in FIG. 5. This is made from any abrasion resistant thin sheet material capable of having 0.03 micron holes or slots blown through its thickness while turning on a turnstile or lathe. This thin-walled, tapered filer tube 42 is thereafter installed inside of a reinforcing, relatively large pore thick-walled matching tapered tube to prevent distortion under pressure.

The relocation of the input and output air/dust mixtures should be equal. The mixture from outlet 18 of filter 20 enters the spiral centrifugal head chambers 26 where it is centrifugally routed to the head jets 24. These jets spray the air-dust mixture inwardly toward the center of the head 25 which is the vacuum chamber. In route to the head vacuum chamber, the air/dust mixture combines with 325 cfm air being drawn in at both ends of the head 25 preventing any particles from escaping the head as clearly seen in FIG. 2.

Any particles that fail to adhere to extrusion 22 continue into the vacuum chamber, exiting head 25 at outlet 23.

From head outlet 23 the air/dust mixture is drawn by vacuum via tube 19 through valve body inlet screen 21, through valve body vacuum chamber 32, and through an infrared beam which extends between the infrared emitter 44, glass rods 45, and the infrared detector 46 as clearly shown in FIG. 3. The shadows cast on the detector 46 by particles passing through the infrared beam are averaged electronically in control module 48 which determines whether more powder is needed, and if so, actuates gear motor 31 which drives auger screw 30 dispensing more powder from volumetric feed chamber 13 into the vacuum air stream thereby completing the primary function of the external coating process.

The secondary function, internal coating process, works in conjunction with the external coating process beginning with the tapping of the external system gas produce tube 27. The combined pressure from both outlet 34 of compressor 12 and the adjustable back-pressure created by adjusting the butterfly valves 50, forces the air/dust mixture out of the quick-disconnect fitting 27' through tube 11 into the extrusion die plate 29 through a quick disconnect fitting 28.

The die plate tube 37 passes through the extrusion die plate 29 to the inside of the extrusion machine where it can be integrated into the extrusion die plate 29 allowing the air/dust mixture to be injected into the internal cavity of the extrusion 22 as it is being extruded. The air/dust mixture travels the entire length of the extrusion 22 with internal input pressure being continuously adjusted by the butterfly valves 50 to compensate for the increasing length and the resulting increased resistance of the extrusion 22 to air flow.

The air/dust mixture is also being drawn by vacuum to its destination at the take-up reel 36. The hollow extrusion 22 is connected to the vacuum input 52 and tube 54 which passes the air/dust mixture through the core of the take-up reel 36 to the take-up reel vacuum connection 35, and via tube 55, through quick disconnect fitting 57 to the vacuum side of the valve body 14 completing the secondary internal coupling function of the invention.

From the above, it can be seen that the present invention provides means and method for powder dusting various manufactured products such as extrusions, sheet materials, thin films and piece parts. The powder coating device includes a regenerative compressor which propels an air/dust mixture through a control valve body into a cone filter where the majority of the air in the mixture is filtered out. The remaining concentrated air/dust mixture enters the head component where it is centrifugally routed to head jets that direct the air/dust mixture to the item that is being coated. Also, the duster system of the present invention provides a method of coating manufactured products both on their interior and exterior surfaces.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A powder dusting system for products comprising:

a regenerative compressor for propelling an air/dust mixture through a control valve body into a cone shaped filter where a majority of the air in the mixture is filtered out;

a head component operatively connected to the filter, said head component including head jets that direct the air/dust mixture to the products being dusted; and vacuum means for returning any dust particles that do not adhere to the products being dusted back to the regenerative compressor.

2. The system of claim 1 including recirculating means connected to said regenerative compressor for coating the interior surfaces of products utilizing said unadhered dust particles.

3. The system of claim 1 wherein the filter retains all dust particles greater than 0.03 microns.

4. The method of powder dusting for products comprising:

propelling an air/dust mixture from a regenerative compressor through a control valve body into a cone-shaped filter whereby a majority of the air in the mixture is filtered out to form a concentrated air/dust mixture;

propelling the concentrated air/dust mixture to a head component that includes jets that direct the air/dust mixture to products being dusted; and creating a vacuum for returning any dust particles that do not adhere to the products being dusted back to the regenerative compressor to provide a source of recirculated unadhered particles.

5. The method of claim 4 including injecting said recirculated unadhered particles on interior surfaces of said products.

6. The method of claim 4 wherein the filter retains dust particles greater that 0.03 microns.

7. The method of claim 4 wherein the powder used for dusting is selected from the group consisting of talcum and cornstarch.

* * * * *